US009074288B2

(12) United States Patent
Tarrant

(10) Patent No.: US 9,074,288 B2
(45) Date of Patent: Jul. 7, 2015

(54) GALVANIC PANEL WITH COMPLIANT CONSTRUCTION

(75) Inventor: Derek C. Tarrant, Kalispell, MT (US)

(73) Assignee: Jarden Zinc Products, LLC, Greenville, TN (US)

( * ) Notice: Subject to any disclaimer, the term of this patent is extended or adjusted under 35 U.S.C. 154(b) by 307 days.

(21) Appl. No.: 13/547,671

(22) Filed: Jul. 12, 2012

(65) Prior Publication Data

US 2013/0015058 A1 Jan. 17, 2013

Related U.S. Application Data

(60) Provisional application No. 61/506,671, filed on Jul. 12, 2011.

(51) Int. Cl.

| | |
|---|---|
| ***C23F 13/00*** | (2006.01) |
| ***C23F 13/06*** | (2006.01) |
| ***C23F 13/08*** | (2006.01) |

(52) U.S. Cl.

CPC ..... *C23F 13/06* (2013.01); *C23F 13/08* (2013.01); *C23F 2201/02* (2013.01)

(58) Field of Classification Search

CPC ..... C23F 13/00; C23F 13/02; C23F 13/06; C23F 13/08; C23F 13/12; C23F 13/16; C23F 13/18; C23F 2213/06; C23F 2213/20; C23F 2213/22; C23F 13/22; C04B 2111/265

USPC ..... 204/196.33, 196.01–196.36, 204/196.01–196.38; 205/724, 734, 735

See application file for complete search history.

(56) References Cited

U.S. PATENT DOCUMENTS

| | | | | |
|---|---|---|---|---|
| 5,055,166 | A | 10/1991 | Schutt | |
| 5,292,411 | A | 3/1994 | Bartholomew et al. | |
| 5,296,120 | A | 3/1994 | Bennett et al. | |
| 5,714,045 | A * | 2/1998 | Lasa et al. | 204/196.18 |
| 6,183,624 | B1 * | 2/2001 | Whitmore | 205/724 |
| 6,383,364 | B1 | 5/2002 | Austnes | |
| 7,160,433 | B2 | 1/2007 | Bennett | |
| 7,226,532 | B2 * | 6/2007 | Whitmore | 205/734 |
| 7,909,982 | B2 * | 3/2011 | Glass et al. | 205/734 |
| 7,998,321 | B1 | 8/2011 | Giorgini | |
| 8,157,983 | B2 | 4/2012 | Bennett | |
| 2011/0108413 | A1 | 5/2011 | Tarrant et al. | |

FOREIGN PATENT DOCUMENTS

| | | |
|---|---|---|
| EP | 0147977 A2 | 10/1985 |

OTHER PUBLICATIONS

Merriam-Webster defintion of spongy.*

* cited by examiner

*Primary Examiner* — Luan Van
*Assistant Examiner* — Alexander W Keeling
(74) *Attorney, Agent, or Firm* — Lawrence J. Shurupoff

(57) ABSTRACT

A prefabricated sacrificial galvanic anode panel includes a rigid or semi-rigid backing board or similar support surface over which a thin layer of cement, mortar or adhesive is applied for holding a compliant layer of material in place on the support surface. The layer of wet adhesive, cement or mortar is sufficiently thin so that upon drying it does not cause warping of the support surface. The compliant or spongy layer is laminated or sandwiched between a thicker layer of ionically conductive galvanic mortar and the substrate support surface. The compliant or spongy layer prevents the thicker layer of galvanic mortar from wetting the backing board or substrate support surface so as to prevent warpage upon drying of the thicker layer of galvanic mortar and also accommodates the expansion of corrosion products from the galvanic anode material.

12 Claims, 2 Drawing Sheets

GALVANIC PANEL WITH COMPLIANT CONSTRUCTION

CROSS REFERENCE TO RELATED APPLICATION

This application claims the benefit and priority of U.S. provisional patent application No. 61/506,671, filed on Jul. 12, 2011 and is incorporated herein by reference in its entirety.

BACKGROUND AND SUMMARY

Galvanic anodes are electrically connected to steel reinforced concrete structures to protect the steel from corrosion. In the course of protecting the steel to which they are attached, galvanic anodes can expand due to the formation of corrosion products from the sacrificial metal, which is usually zinc. In severe cases, such expansion can cause the buildup of stresses within the concrete in which the galvanic anode is buried. Such stresses can compromise the integrity of the concrete covering causing it to crack or rupture.

Another problem with large galvanic anodes, and particularly planar galvanic anodes, is caused by differential expansion and contraction between active galvanic layers within the anode and the support substrates and/or with respect to the base concrete to which such panel-shaped anodes are attached. This expansion and contraction can cause the layered galvanic anode construction to distort or warp, compromise its internal physical integrity and/or cause disruption of the bond between a backing substrate and active galvanic material or with the base concrete to which such anodes are attached. Such expansion, contraction and warpage can be caused by many factors such as differential drying rates between layers within the anode during manufacture or use and/or the buildup of corrosion products in operation.

The incorporation of a stress relieving compliant layer in the laminated manufacture of large planar supported galvanic anode panels allows the panels to stay perfectly flat and/or free of warpage and distortion no matter what the degree of differential expansion/contraction between substrate and anode portions of the composite product.

The compliant layer also imparts a degree of sound deadening and sound insulation to the finished panel.

Previous attempts to solve the cracking and warping problem associated with the fabrication and use of large galvanic anode panels have been directed at forcefully restraining any such expansion by the use of high strength reinforcing layers that bind the active portion of the anode in such a way that the expansion forces are prevented from compromising the adhesion to or structural integrity of the concrete within or against which such anodes are used.

These problems are addressed and solved below without forceful restraint with the use of a compressible, compliant and/or spongy layer of material interposed between the active galvanic anode portion of the overall construction and the supporting carrier or substrate which can form part of the construction. The substrate can take the form of a fiberboard or concrete or mortar "backer board" commercially available in the form of flat planar rectangular panels in sizes several feet on a side, similar to plywood panels.

The compliant, compressible or spongy layer can also be used between galvanic anodes and the concrete structure containing the steel which is to be protected, as long as provision is made for the passage of ions through the compliant, compressible or spongy layer. Such ionic passage can be an intrinsic property of the compressible layer such as natural materials like paper products or provided with additives such as humectants, deliquescents or water absorbers which can be incorporated into the compliant layer to render it ionically conductive.

The compliant, compressible and/or spongy layer in this new galvanic panel construction can be a layer of soft plastic or rubber sponge or foam, or a sheet of a woven, a nonwoven or flocked fabric, such as felt. In one embodiment, a needle-punched nonwoven fabric is used. For good results, the construction of the fabric is ideally "lofty" with good spacing and void spaces between fibers and/or air cells and not too dense. The compliant, compressible or spongy layer is bonded into the construction by a galvanic mortar applied between it and the substrate on one side and between the compliant, compressible and/or spongy layer and the galvanic anode mortar containing the galvanic metal anode on the other side.

The thickness of the compliant, compressible and/or spongy layer and the viscosity or composition of the surrounding mortar or adhesive, plus the degree of mechanical compaction in the manufacturing process are chosen to be such that the galvanic mortar and adhesive penetrates or adheres partially into or onto the face of the compliant material from both sides. The penetration is ideally sufficient to develop a sound mechanical bond between the mortar and each facing of the compliant, compressible and/or spongy layer once the mortar and adhesive has dried and cured but not so much that the mortar or adhesive penetrates entirely through the compliant media. This results in a central or interior portion of the compliant, compressible and/or spongy layer remaining unfilled with mortar leaving an open air filed layer which allows for this layer to compressively absorb any stresses or movement between layers of the anode construction, however caused. In one embodiment, the compliant, compressible or spongy material can be about 1/16 to 1/4 inch thick.

This construction can be used to make large flat stress-free supported galvanic anode panels for use on virtually any reinforced concrete structures, such as building walls and floors, concrete decks and pilings, parking structures and the like. If desired, the support or substrate of the laminated panel construction can be provided with an external decorative surface or painted or otherwise formed with decorative or functional embossed patterns or text.

DESCRIPTION OF REPRESENTATIVE EMBODIMENTS

Figure 1:
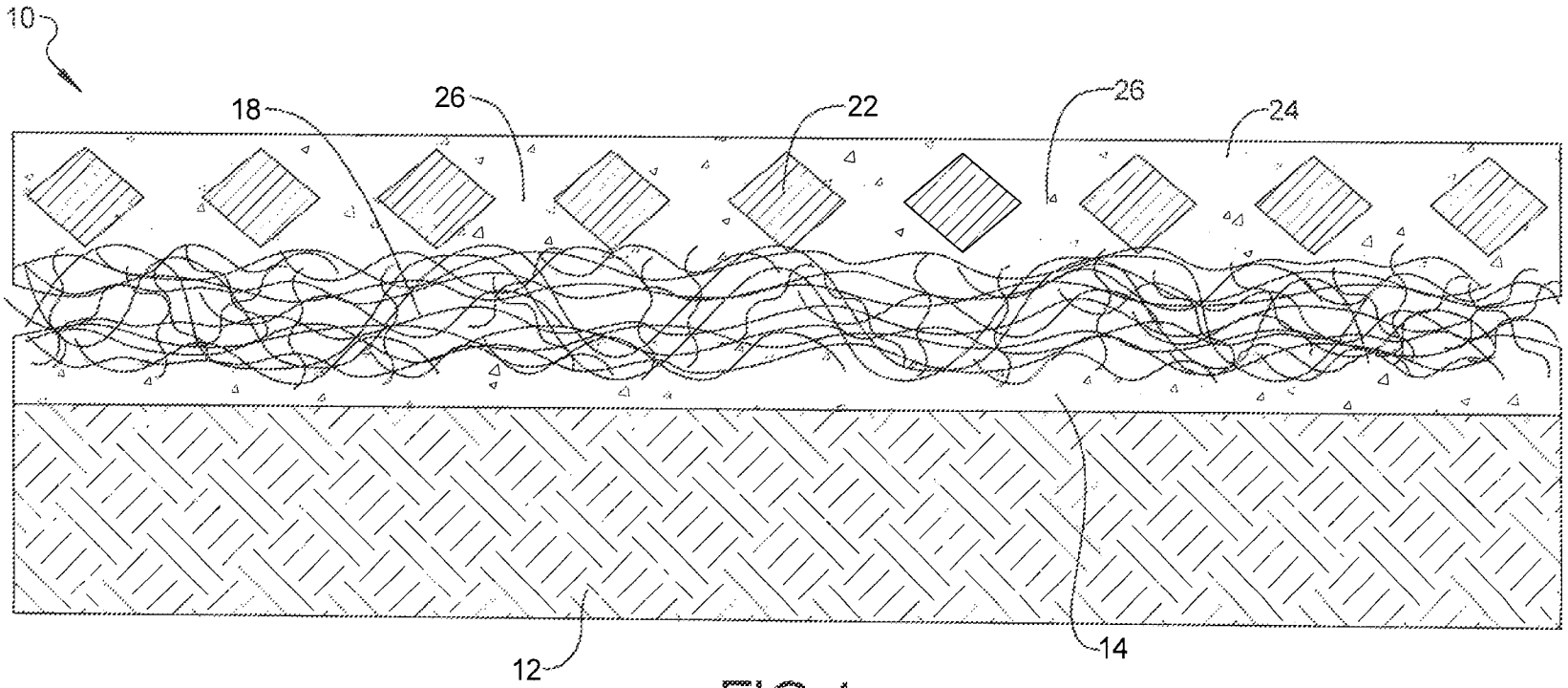
FIG. 1 is a partial view in cross section of a representative embodiment of a compliant galvanic anode assembly.

As seen in FIG. 1, a laminated galvanic anode panel 10 includes a base layer 12 which serves as an electrically and galvanically inert substrate. Panel 10 is typically formed as a flat planar panel, but may be formed with any contour, such as semi-cylindrical contour or an "L" shaped contour. The base layer 12 can be any one of various commercially available panels or backer boards, such as compressed fiberboard, mortar board or other semi-rigid material. A layer of galvanic mortar 14 or other adhesive is applied to one surface of the base layer 12, such as by spraying or rolling. This can be a relatively thin adhesive layer having a relatively small amount of water, solvent or other liquid content. This prevents saturation or significant wetting of the underlying base layer 12 and thereby reduces or eliminates warpage of the base layer 12 as the mortar or adhesive 14 dries.

A layer or sheet of a compressible, compliant and/or spongy, air filled fabric or open cell sponge or foam material 18 is placed over the wet galvanic mortar or adhesive 14 and pressed downwardly so that a thin layer of the mortar or adhesive 14 extrudes or flows into and through the surface of the compressible material 18. If a closed cell foam is used, then the mortar or adhesive should securely bond to the surface of the material 18. Only a thin layer of the compressible material 18 is covered with the mortar or adhesive 14 so that the majority of the material 14 remains compressible and compliant.

Next, a sacrificial galvanic anode material 22 is placed on the exposed or upper surface of the compressible material 18. The anode material 22 can be in the form of an open mesh, expanded metal, perforated metal or even sheet material. A preferred anode material 22 is zinc mesh, but any sacrificial galvanic materials, as compared to steel, can be used.

In order to bond the anode material 22 to the compressible material 18, a relatively thick layer of wet galvanic mortar 24 is applied over the anode material 22 and squeezed or extruded through the openings 26 between the mesh wire strands or other openings in the anode material 18. Sufficient pressure is applied to the wet galvanic mortar 24 to force it into bonding adhesive contact with the upper surface of the compressible material 18. Only a thin upper layer of the compressible material 18 is covered with galvanic mortar 24 so that the central portion of the compressible material remains compressible with open air pockets, void spaces and/or air channels. Any type of galvanic mortar may be used which efficiently conducts ions through the mortar.

It is also possible to first apply a layer of galvanic mortar 24 to the upper surface of the compressible material 18 and then embed the sacrificial anode material into the galvanic mortar by downward pressing or rolling or other mechanical means. This method can be used when solid flat plate anode material is used.

It should be noted that by separating the relatively thick layer of galvanic mortar 24 from the base layer 12 with the intermediate layer of compliant, compressible and/or spongy material 18, the base layer 12 is prevented from becoming soaked by the wet galvanic mortar 24. This reduces or eliminates warping of the base layer 12 caused by excessive wetting and/or subsequent drying.

Moreover, as the thick layer of galvanic mortar 24 dries and hardens, any expansions and contractions of the drying mortar are absorbed by the compliant layer 18 so as to further protect the base layer 12 from warping or other undesirable deformation forces caused by movement of the drying galvanic mortar layer 24.

While the base layer 12 can be provided as flat panels in virtually any desired size, such as in squares from one to 10 feet on a side, or in rectangles with major length sides up to 12 feet or more, they can also be provided in preformed contoured shapes, such as arcuate, V-shaped or any other desired form. Panels 10 can also be provided in smaller sizes such as in the size of household floor tiles or bathroom tiles. The outer surface of the base layer 12 can be embossed or formed with a decorative design or other images or text.

Figure 2:
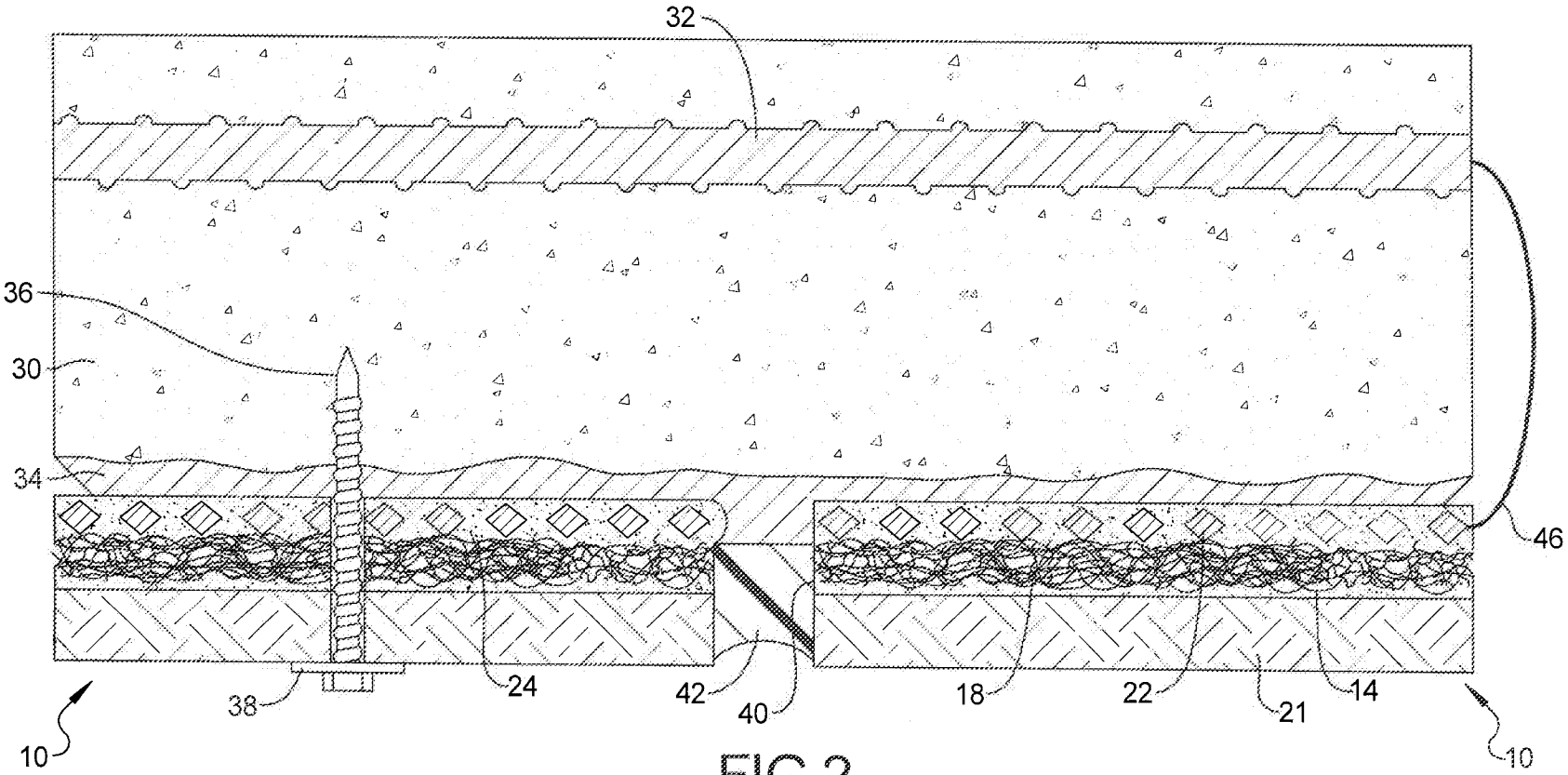
FIG. 2 is a partial view in cross section of the galvanic anode assembly of FIG. 1 mounted to a reinforced concrete structure.

As seen in FIG. 2, a pair of galvanic anode panels 10 of FIG. 1 is attached to a concrete structure 30 which is reinforced with steel reinforcing members such as steel rebars 32. A layer 34 of galvanically conductive cement or mortar is applied over the surface of the concrete structure 30 which is to be galvanically protected, and/or applied over the top or inner surface of the rigid or semi-rigid galvanic anode panel 10. The galvanic anode panel 10 is then placed in position over the concrete structure 30 and maintained in position until the layer 34 of cement or mortar dries, sets, hardens and bonds the galvanic anode panel 10 to the concrete structure 30.

Concrete mounting screws 36 with mounting washers 38 can be used to temporarily or permanently hold the galvanic anode panel 10 in position as shown. Spacings or gaps 40 between adjacent galvanic anode panels 10 can be sealed with waterproofing caulk 42.

A metal, electrically conductive wire 46, such as a steel connector wire, is welded, screwed, soldered, crimped or otherwise held in electrical communication with the anode material 22 and the steel reinforcement 32 to provide an electrical path therebetween. The remainder of an electrical circuit passes ionically or galvanically from the rebar 32, through the concrete structure 30, through the mortar or cement layer 34, through the galvanic mortar 24 and into the anode material 22.

It will be appreciated by those skilled in the art that the above galvanic panel with compliant construction is merely representative of the many possible embodiments of the invention and that the scope of the invention should not be limited thereto, but instead should only be limited according to the following claims.

What is claimed is:

1. A compressible galvanic panel constructed for attachment to a concrete structure, comprising:

a base layer comprising a backer board having a preformed shape;

an adhesive applied over said base layer;

a layer of compliant compressible air filled material having void spaces therein and held on said base layer by said adhesive;

a layer of galvanic mortar applied over said layer of compliant compressible air filled material such that said layer of compliant compressible air filled material separates said adhesive and said layer of galvanic mortar and prevents passage of said adhesive and said layer of galvanic mortar therethrough; and a sacrificial galvanic anode material provided in said layer of galvanic mortar; and wherein said layer of compliant compressible air-filled material comprises a first side bonded to said base layer, a second side bonded to said sacrificial galvanic anode material, and a compliant compressible layer unfilled with said adhesive and said galvanic mortar;

wherein said compliant compressible layer comprises an open air filled layer between said first and second sides of said layer of compliant compressible air-filled material which compressively absorbs stresses and expansion of corrosion products from said sacrificial galvanic anode material.

2. The panel of claim 1, wherein said layer of compliant compressible air filled material comprises a fabric material.

3. The panel of claim 1, wherein said layer of compliant compressible air filled material comprises a spongy material.

4. The panel of claim 1, wherein said adhesive comprises a layer of adhesive which is thinner than said layer of galvanic mortar to reduce wetting of said base layer.

5. The panel of claim 4, wherein said layer of adhesive comprises a layer of mortar.

6. The panel of claim 1, wherein said sacrificial galvanic anode material comprises zinc.

7. The panel of claim 6, wherein said sacrificial galvanic anode material comprises a zinc mesh and wherein said layer of galvanic mortar extrudes through said zinc mesh.

8. The panel of claim 1, wherein said layer of compliant compressible air filled material comprises a thickness of about 1/16 to 1/4 inch.

9. The panel of claim 1, wherein said layer of compliant compressible air filled material prevents said layer of galvanic mortar from wetting said base layer.

10. A reinforced concrete structure, comprising:

a layer of concrete;

a steel reinforcement at least partially embedded in said layer of concrete;

a galvanic panel attached on said layer of concrete, said galvanic panel comprising a base layer comprising a semi-rigid backer board having a preformed shape, an adhesive applied over said base layer, a layer of compliant compressible air filled material having void spaces therein arid held on said base layer by said adhesive, a first layer of galvanic mortar applied over said layer of compliant compressible material, and a sacrificial galvanic anode material provided in said first layer of galvanic mortar wherein said layer of complaint compressible material separates said adhesive and said layer of galvanic mortar and prevents passage of said adhesive and said layer of galvanic mortar therethrough wherein said layer of compliant compressible air-filled material comprises a first side bonded to said base layer, a second side bonded to said sacrificial galvanic anode material, and a compliant compressible layer unfilled with said adhesive and said galvanic mortar;

and wherein said compliant compressible layer comprises an open air filled layer between said first and second sides of said layer of compliant compressible air-filled material which compressively absorbs stresses and expansion of corrosion products from said sacrificial galvanic anode material; and an electrical connector electrically connecting said sacrificial galvanic anode material and said steel reinforcement.

11. The concrete structure of claim 10, wherein said electrical connector comprises a steel wire.

12. The concrete structure of claim 10, further comprising a second layer of galvanic mortar between said layer of concrete and said galvanic panel.

* * * * *